US007273382B2

(12) United States Patent
Igarashi et al.

(10) Patent No.: US 7,273,382 B2
(45) Date of Patent: Sep. 25, 2007

(54) ELECTRICAL CONNECTOR AND ELECTRICAL CONNECTOR ASSEMBLY

(75) Inventors: Isao Igarashi, Tokyo (JP); Akira Kubo, Tokyo (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 11/365,911

(22) Filed: Mar. 1, 2006

(65) Prior Publication Data

US 2006/0199417 A1 Sep. 7, 2006

(30) Foreign Application Priority Data

Mar. 4, 2005 (JP) ..... 2005-060642

(51) Int. Cl.
*H01R 13/44* (2006.01)

(52) U.S. Cl. ..... 439/141; 439/374

(58) Field of Classification Search ..... 439/140, 439/141, 374, 677, 680
See application file for complete search history.

(56) References Cited

U.S. PATENT DOCUMENTS 6,955,546 B1 * 10/2005 Huang ..... 439/135
2005/0136713 A1 * 6/2005 Schell et al. ..... 439/140

FOREIGN PATENT DOCUMENTS

JP 11-288760 10/1999

* cited by examiner

*Primary Examiner*—Khiem Nguyen
(74) *Attorney, Agent, or Firm*—Barley Snyder LLC

(57) ABSTRACT

An electrical connector has an insulating housing provided with first and second contacts. A positioning guide protrudes from a mating surface of the housing. At least one barrier wall is formed between the first and second contacts that separates the first contacts from the second contacts. A mating connector has an insulating mating housing provided with first and second mating contacts and a positioning recessed member that receives the positioning guide. A barrier wall recessed member is formed between the first and second mating contacts that separates the first mating contacts from the second mating contacts. The barrier wall recessed member receives the barrier wall when the electrical connector is mated with the mating connector. A shutter member is provided on the mating connector and is moveable between an upper position and a lower position. The shutter member covers the first and second mating contacts in the upper position.

11 Claims, 8 Drawing Sheets

ELECTRICAL CONNECTOR AND ELECTRICAL CONNECTOR ASSEMBLY

FIELD OF THE INVENTION

The invention generally relates to an electrical connector and an electrical connector assembly suitable for connecting an expansion unit and an electronic device such as a personal computer to each other.

BACKGROUND OF THE INVENTION

An electronic device such as a personal computer and an expansion unit are designed to be connected to each other by mating an electrical connector provided on the electronic device with an electrical connector provided on the expansion unit. Generally, the electrical connector provided on a side of the expansion unit and the electrical connector provided on a side of the electronic device are collectively referred to as a "docking connector."

In the docking connector, it is important that the contacts of the electrical connector provided on the side of the expansion unit and the contacts of the electrical connector provided on the side of the electronic device are correctly aligned with each other so that proper electrical connection there between is ensured. An example of a docking connector that ensures proper contact alignment is shown in FIG. 6 (see JP11-288760A). FIG. 6 shows a docking connector 101 consisting of a first connector 110 that mates with a second connector 120. The first connector 110 is mounted on a circuit board provided on a side of a personal computer (not shown) and comprises an insulating first housing 111 and a plurality of contacts (not shown). A pair of positioning guide pins 112 protrudes from a mating surface at ends of the first housing 111. The positioning guide pins 112 are constructed so that the positioning guide pin 112 on one end of the first housing 111 has a larger diameter than the positioning guide pin 112 on the other end of the first housing 111.

The second connector 120 is mounted on a circuit board provided on a side of an expansion unit (not shown) and comprises an insulating second housing 121 and a plurality of contacts (not shown). A pair of guide bushes 122 into which the positioning guide pins 112 of the first connector 110 are inserted are provided at ends of the second housing 121. Power supply contacts (not shown) through which a relatively large current flows and signal contacts (not shown) through which a relatively small current flows are generally provided on both the first and second connectors 110, 120. When the positioning guide pins 112 are inserted into the guide bushes 122 during the mating of the first connector 110 with the second connector 120, any positional deviation between the first connector 110 and the second connector 120 is absorbed, so that it is possible to accurately align all of the signal contacts (not shown) and power supply contacts (not shown) with each other.

FIG. 7 shows another example of an electrical connector that is provided on a side of an expansion unit. FIG. 7 shows an electrical connector 201 having an insulating housing 210 that extends in a direction of length (left-right direction in FIG. 7). The housing 210 comprises a housing base 211 that extends in the direction of length. A mating member 212 protrudes upward from the housing base 211 and extends in the direction of length. The mating member 212 mates with a mating connector (not shown) that is provided on a side of a personal computer and has a pair of mating recessed members 212*b* (only the front-side mating recessed members 212*b* are shown in the figure) in front and back thereof.

One of the mating recessed members 212*b* is provided on each side of a partition wall 212*a*. A pair of positioning guides 213 that protrude upward with respect to a mating surface of the mating member 212 (i.e., the upper-end surface of the mating member) are provided on either end of the housing base 211 in the direction of length.

A plurality of signal contacts 221 are provided on front and rear surfaces of each of the mating recessed members 212*b*. A plurality of power supply contacts 222 are provided on front and rear surfaces of each of the mating recessed members 212*b* in positions that are separated by a specified interval from the respective rightmost-end of the signal contacts 221 in the direction of length. The signal contacts 221 are electrically connected to signal lines (not shown) of a circuit board (not shown), and the power supply contacts 222 are electrically connected to power supply lines (not shown) of a circuit board (not shown). In the electrical connector 201 shown in FIG. 7, when a conductive piece M such as a clip enters an interior of one of the mating recessed members 212*b* of the mating member 212, the signal contacts 221 and/or the power supply contacts 222 may be shorted by the conductive piece M, which can damage the components of the docking connector.

BRIEF SUMMARY OF THE INVENTION

It is therefore an object of the invention to provide an electrical connector and an electrical connector assembly which properly aligns the electrical connector with a mating connector and prevents shorting from occurring between first and second contacts provided therein.

This and other objects are achieved by an electrical connector comprising an insulating housing provided with first and second contacts. A positioning guide protrudes from a mating surface of the housing. At least one barrier wall is formed between the first and second contacts that separates the first contacts from the second contacts.

This and other objects are further achieved by an electrical connector assembly comprising an electrical connector and a mating connector. The electrical connector has an insulating housing provided with first and second contacts. A positioning guide protrudes from a mating surface of the housing. At least one barrier wall is formed between the first and second contacts that separates the first contacts from the second contacts. The mating connector has an insulating mating housing provided with first and second mating contacts and a positioning recessed member that receives the positioning guide. At least one barrier wall recessed member is formed between the first and second mating contacts and separates the first mating contacts from the second mating contacts. The barrier wall recessed member receives the barrier wall when the electrical connector is mated with the mating connector.

DETAILED DESCRIPTION OF THE INVENTION

Figure 1:
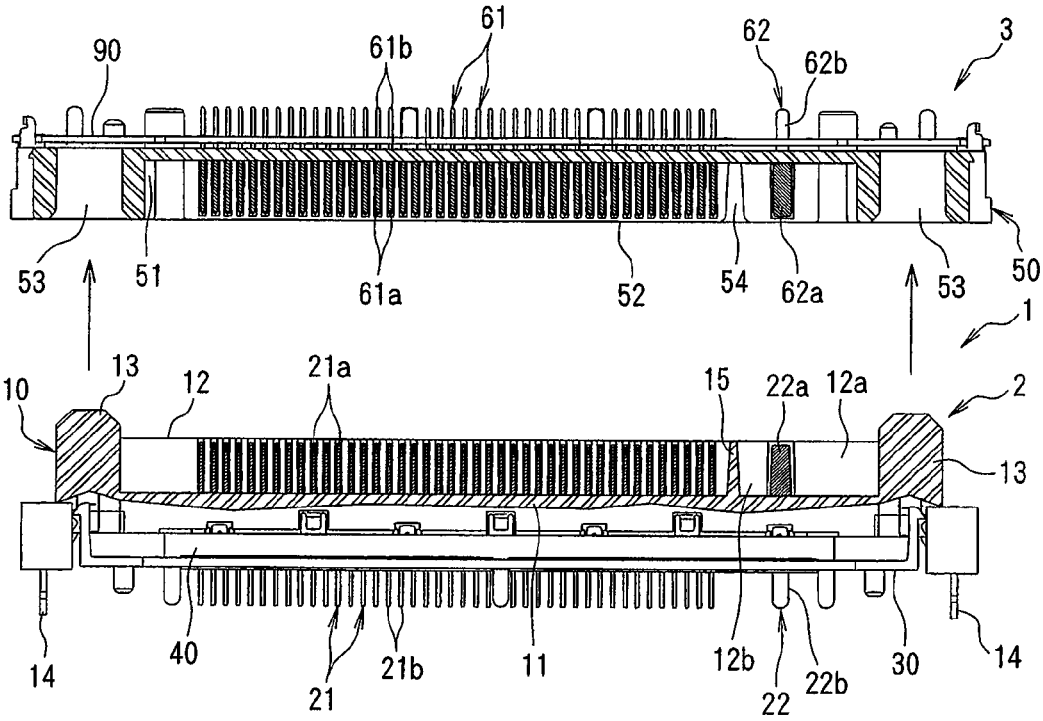
FIG. 1 is an exploded sectional view of an electrical connector assembly of the invention showing an electrical connector prior to mating with a mating connector (a shutter member is not shown)

FIG. 1 shows an electrical connector assembly 1 according to the invention. The electrical connector assembly 1 comprises an electrical connector 2 that mates with a mating connector 3. The electrical connector 2 may be mounted, for example, on a circuit board (not shown) provided on a side of an expansion unit (not shown), and the mating connector 3 may be mounted, for example, on a circuit board (not shown) provided on a side of a personal computer (not shown) to form a so-called docking connector.

Figure 2A:
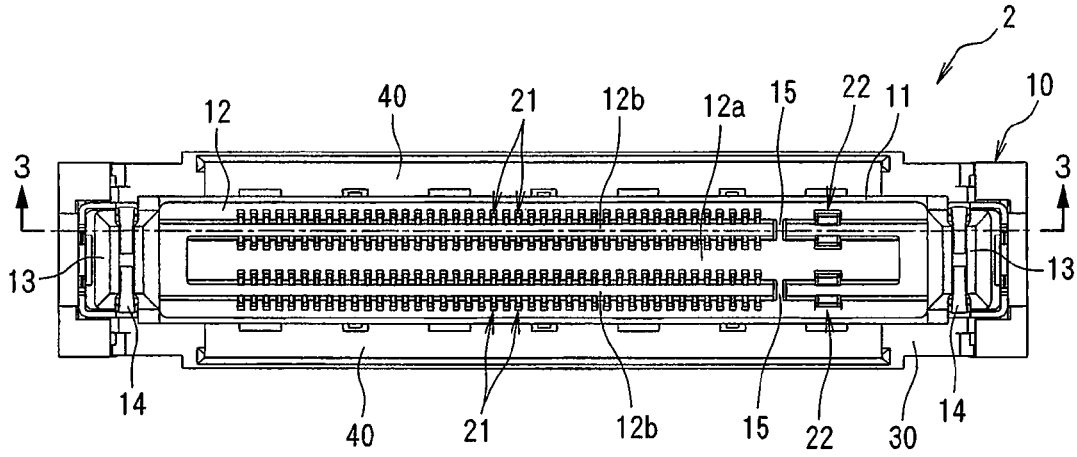
FIG. 2A is a plan view of the electrical connector of FIG. 1.
Figure 2B:
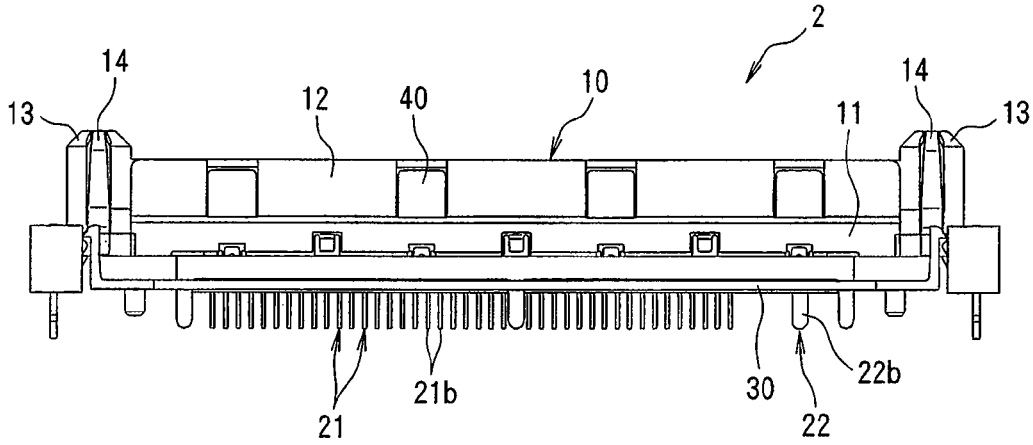
FIG. 2B is a front view of the electrical connector of FIG. 1.
Figure 2C:
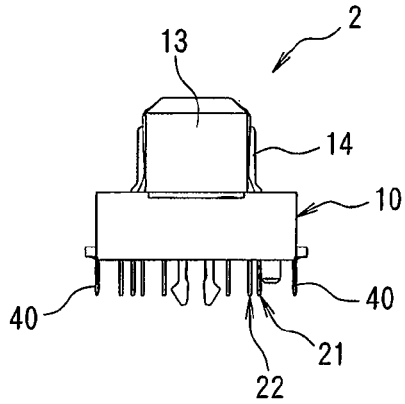
FIG. 2C is a right-side view of the electrical connector of FIG. 1.

As shown in FIG. 1, the electrical connector 2 comprises an insulating housing 10. As shown in FIGS. 2A-2C, the housing 10 has a substantially rectangular shape and may be formed, for example, by molding an insulating resin. The housing 10 includes a housing base 11 that extends in a direction of length (left-right direction in FIG. 1). A mating member 12 protrudes upward from the housing base 11 and extends in the direction of length. The mating member 12 is used for mating with the mating connector 3 and has a pair of mating recessed members 12*b* on a front and back side thereof each side of a partition wall 12*a*. Positioning guides 13 are provided at ends of the housing base 11 in the direction of length. The positioning guides 13 protrude upward with respect to a mating surface of the mating member 12 (i.e., an upper-end surface of the mating member 12). Each of the positioning guides 13 is provided with a metal plate 14 formed for contacting corresponding shell members 80 (FIGS. 5A-5C) on the mating connector 3. The positioning guides 13 ground the electrical connector 2 and fasten the electrical connector 2 to the circuit board (not shown). Shells 40 are attached to a front surface and a rear surface of the housing 10. Each of the shells 40 is grounded to the surface of the circuit board (not shown) provided on the side of the expansion unit (not shown). The shells 40 may be, for example, made of metal.

Figure 3:
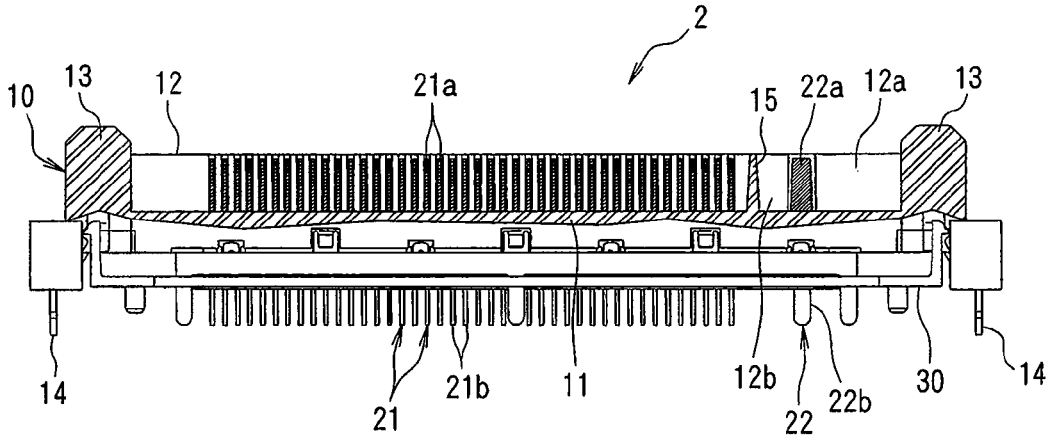
FIG. 3 is a sectional view along line 3-3 of FIG. 2A.

First and second contacts 21, 22, respectively, are attached to the insulating housing 10. The first contacts 21 are, for example, signal contacts and are attached in rows at a specified pitch along the front and rear surfaces of the respective mating recessed members 12*b* of the housing 10. As shown in FIGS. 1 and 3, each of the first contacts 21 comprises a contact member 21*a* and a board connecting member 21*b*. The contact members 21*a* extend upward along the front and rear surfaces of the mating recessed members 12*b*. The board connecting members 21*b* extend so that the board connecting members 21*b* protrude downward from the housing base 11. The board connecting members 21*b* are connected to a signal line of the circuit board (not shown) provided on the side of the expansion unit (not shown). Each of the first contacts 21 may be formed, for example, by stamping and forming a metal plate.

The second contacts 22 are, for example, power supply contacts and are attached to the front and rear surfaces of the respective mating recessed members 12*b* of the housing 10 in positions separated by a specified interval from the respective rightmost-end of the first contacts 21 in the direction of length. Each of the second contacts 22 comprises a contact member 22*a* and a board connecting member 22*b*. The contact members 22*a* of the second contacts 22 extend upward along the front and rear surfaces of the mating recessed members 12*b*. The board connecting members 22*b* extend so that the board connecting members 22*b* protrude downward from the housing base 11. The board connecting members 22*b* are connected to a power supply line (not shown) of the circuit board (not shown) provided on the side of the expansion unit (not shown). Each of the second contacts 22 may be formed, for example, by stamping and forming a metal plate.

A tine plate 30 is provided on the housing 10. The tine plate 30 aligns the board connecting members 21*b* of the first contacts 21 and the board connecting members 22*b* of the second contacts 22. The tine plate 30 is installed on the housing 10 so that the tine plate 30 can move upward and downward between a temporary locking position and a main locking position beneath the housing base 11.

Figure 4:
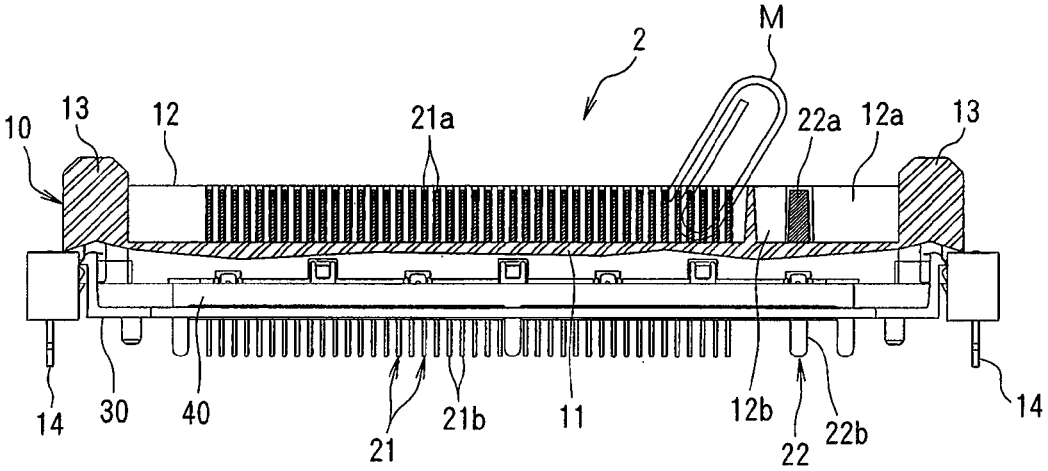
FIG. 4 is a sectional view along line 3-3 of FIG. 2A showing an example of a conductive piece entering an interior of a mating recessed member.

As shown in FIG. 2A, a pair of barrier walls 15 is provided in each of the mating recessed members 12*b* of the mating member 12 of the housing 10. The barrier walls 15 are disposed at a rightmost-end of the first contacts 21 between the first contacts 21 and the second contacts 22 so as to partition the first contacts 21 from the second contacts 22. The barrier walls extend upward from the bottom surfaces of the mating recessed members 12*b* to the mating surface of the mating member 12 (i.e., the upper-end surface of the mating member). The barrier walls 15 are formed such that the barrier walls 15 become gradually narrower toward a top thereof. As shown in FIG. 4, for example, even if a conductive piece M, such as a clip, enters an interior of one of the mating recessed members 12*b* on the side of the first contacts 21, the barrier walls 15 cause the conductive piece M to contact only the second contacts 22, thus short-circuiting of the first and second contacts 21, 22 can be avoided. Conversely, if a conductive piece M enters the interior of one of the mating recessed members 12*b* on the side of the second contacts 22, the barrier walls 15 cause the conductive piece M to contact only the first contacts 21, thus short-circuiting of the first and second contacts 21, 22 can be avoided. Consequently, there is no damage to the first contacts 21 and the signal lines (not shown) on the circuit board (not shown) caused by a large current flowing through the first contacts 21 and the signal lines (not shown).

Figure 5A:
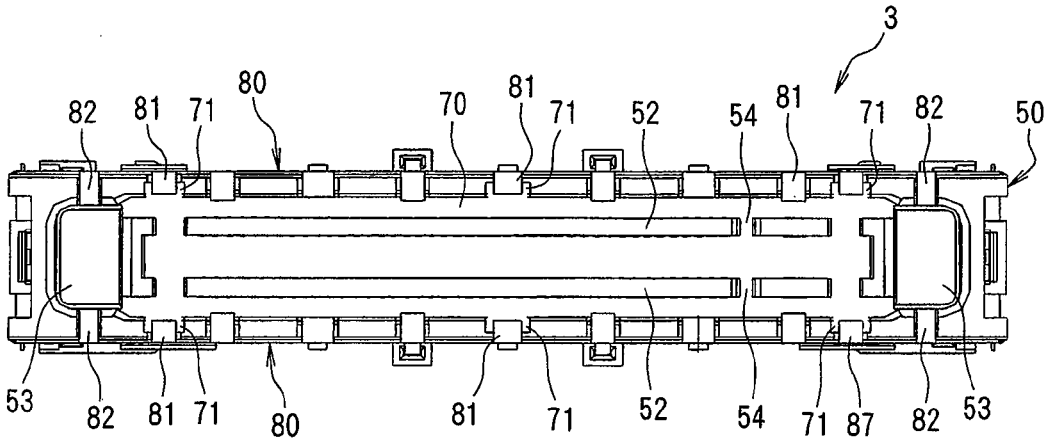
FIG. 5A is a plan view of the mating connector of FIG. 1.
Figure 5B:
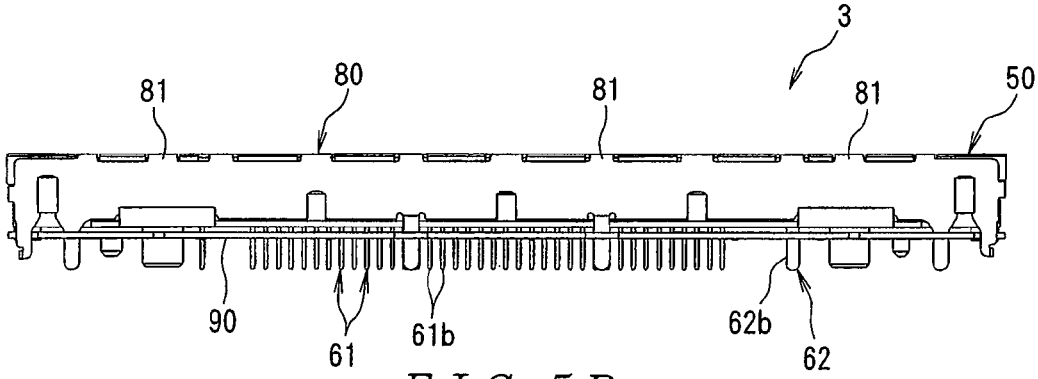
FIG. 5B is a front view of the mating connector of FIG. 1.
Figure 5C:
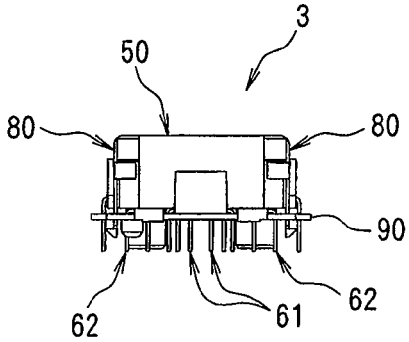
FIG. 5C is a right-side view of the mating connector of FIG. 1.
Figure 5D:
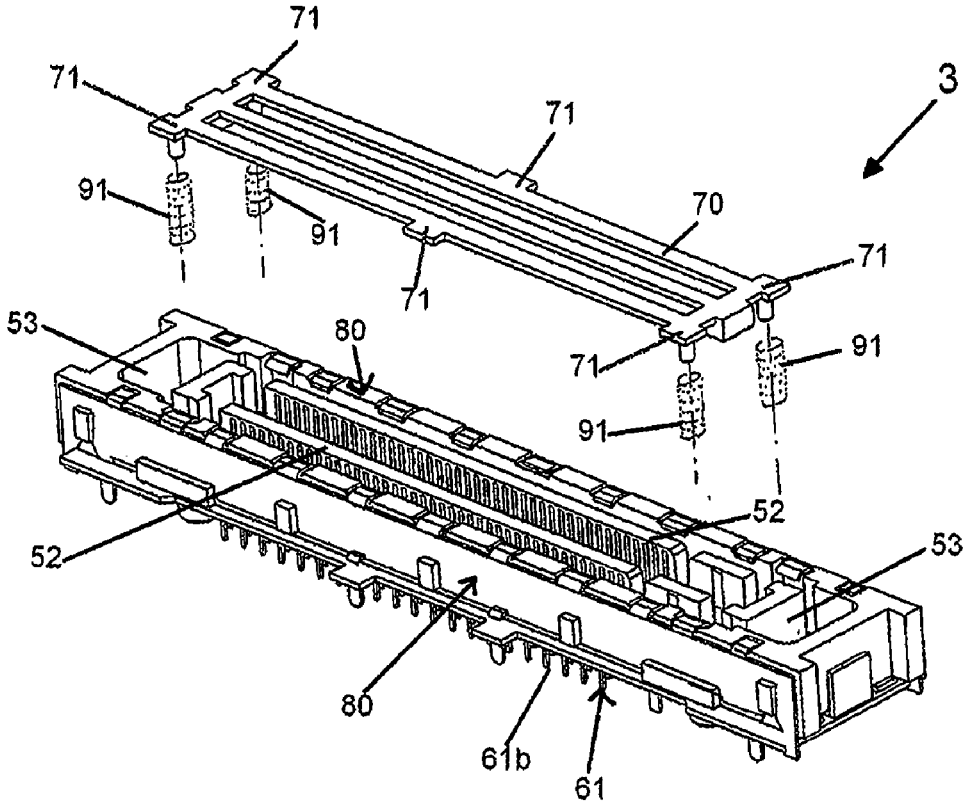
FIG. 5D is an exploded view of the mating connector of FIG. 1.
Figure 5E:
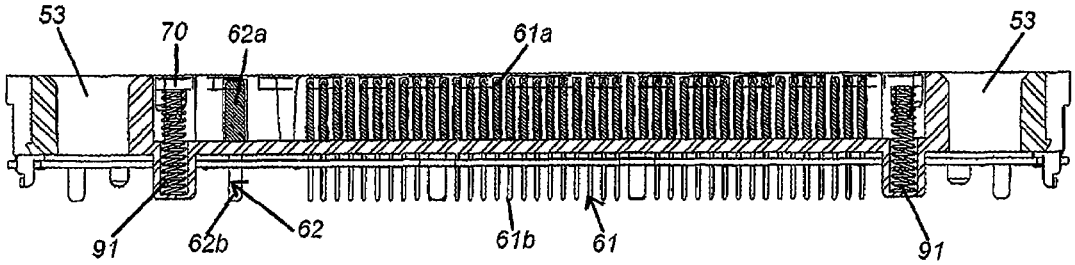
FIG. 5E is a sectional view of the mating connector of FIG. 1 showing a shutter member in an upper position.
Figure 5F:
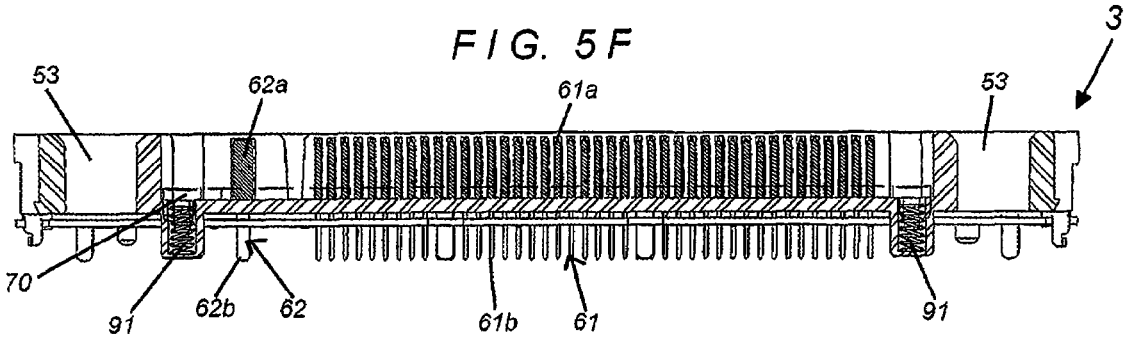
FIG. 5F is a sectional view of the mating connector of FIG. 1 showing the shutter member in a lower position.
Figure 6:
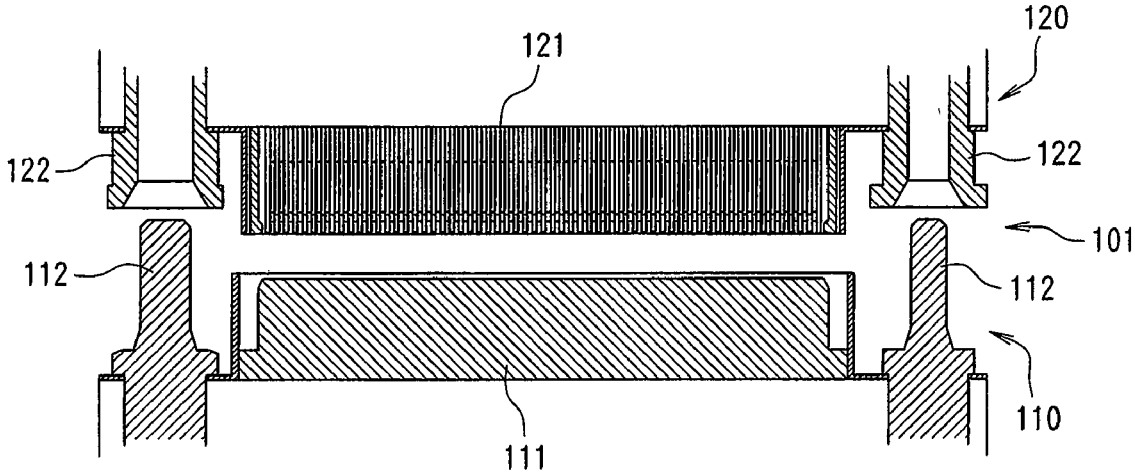
PRIOR ART FIG. 6
FIG. 6 is a schematic diagram of a docking connector according to the prior art.
Figure 7:
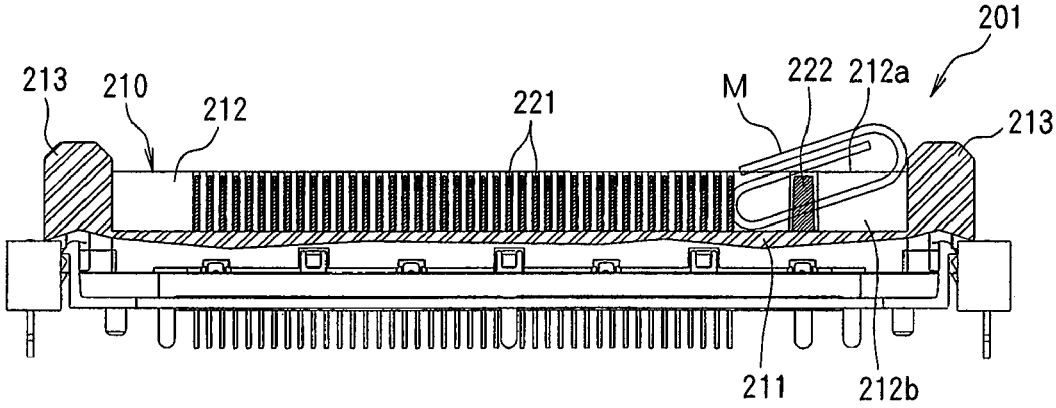
PRIOR ART FIG. 7
FIG. 7 is a sectional view of an electrical connector according to the prior art.

As shown in FIGS. 1 and 5A-5C, the mating connector 3 comprises an insulating mating housing 50. The mating housing 50 has a substantially rectangular shape that is formed, for example, by molding an insulating resin. As shown in FIG. 5A, the mating housing 50 comprises a mating recessed member 51 that extends in a direction of length (left-right direction in FIG. 1). Mating protruding members 52 protrude from a bottom surface of the mating recessed member 51 and extend in the direction of length. The electrical connector assembly 1 is formed so that the mating member 12 of the electrical connector 2 enters an interior of the mating recessed member 51 and so that the mating protruding members 52 enter an interior of the mating recessed members 12*b* of the electrical connector 2, simultaneously. A positioning recessed member 53 into which the positioning guides 13 of the electrical connector 2 are inserted are provided at ends of the mating recessed member 51 in the direction of length. Shell members 80 are attached to front and rear surfaces of the mating housing 50. Tongue members 82 that are contacted by the metal plates 14 of the electrical connector 2 during mating with the electrical connector 2 are provided on each of the shell members 80 so that the tongue members 82 extend into the positioning recessed members 53. The shell members 80 are designed to be grounded to the circuit board (not provided) that is provided on the side of the personal computer (not shown). The shell members 80 may be made, for example, of metal.

A plurality of first mating contacts 61 and second mating contacts 62 are attached to the mating housing 50. The first mating contacts 61 may be, for example, signal contacts and are attached in rows at a specified pitch along front and rear surfaces of the mating protruding members 52 of the mating housing 50. As shown in FIG. 1, each of the first mating contacts 61 comprises a contact member 61*a* that contacts the contact member 21*a* of the first contact 21 of the electrical connector 2 and a board connecting member 61*b* that is connected to a signal line (not shown) of the circuit board (not shown) provided on the side of the personal computer (not shown). The contact members 61*a* of the respective first mating contacts 61 extend upward along front and rear surfaces of the respective mating protruding members 52. The board connecting members 61*b* extend so that the board connecting members 61*b* protrude downward from the mating housing 50. Each of the first mating contacts 61 may be formed, for example, by stamping and forming a metal plate.

The second mating contacts 62 may be, for example, power supply contacts and are attached to front and rear surfaces of the mating protruding members 52 of the mating housing 50 in positions separated by a specified interval from the respective rightmost-end of the first mating contacts 61 in the direction of length. As shown in FIG. 1, each of the second mating contacts 62 comprises a contact member 62*a* that contacts the contact member 22*a* of the corresponding power supply contact 22 of the electrical connector 2 and a board connecting member 62*b* that is connected to a power supply line (not shown) of the circuit board (not shown) provided on the side of the personal computer (not shown). The contact members 62*a* of the second mating contacts 62 extend upward along front and rear surfaces of the mating protruding members 52. The board connecting members 62*b* extend so that the board connecting members 62*b* protrude downward from the mating housing 50. The second mating contacts 62 may be formed, for example, by stamping and forming a metal plate.

A tine plate 90 is provided on the mating housing 50. The tine plate 90 is used for aligning the board connecting members 61*b* of the first mating contacts 61 and the board connecting members 62*b* of the second mating contacts 62. The tine plate 90 is installed beneath the mating housing 50.

Barrier wall recessed members 54 are formed in the mating protruding members 52 of the mating housing 50 and are disposed between the rightmost-end of the first mating contacts 61 and the second mating contacts 62. The barrier wall recessed members 54 are formed to receive the barrier walls 15 of the electrical connector 2 when the electrical connector 2 mates with the mating connector 3 to avoid interference there between. If the electrical connector 2 is caused to mate with the mating connector 3 in a reversed state, the barrier walls 15 of the electrical connector 2 are not capable of being inserted into the barrier wall recessed members 54 of the mating connector 3. Thus, erroneous mating of the electrical connector 2 with the mating connector 3 is prevented.

As shown in FIGS. 5A-5F, a shutter member 70 is attached to the mating connector 3 and is movable between an upper position (FIG. 5E) and a lower position (FIG. 5F) with respect to the mating housing 50. The shutter member 70 has a substantially rectangular shape and may be formed, for example, by molding an insulating resin. The shutter member 70 is constructed so as to cover the upper portion of the mating recessed member 51 (FIG. 1) excluding the mating protruding members 52. The shutter member 70 is constantly driven in an upward direction by a plurality of elastic members 91 that are disposed at corners of the mating recessed member 51. The shutter member 70 covers the contact members 61*a* of the first mating contacts 61 and the contact members 62*a* of the second mating contacts 62 in the upper position to protect the same. Accordingly, when the shutter member 70 is placed in the upper position, i.e., before the electrical connector 2 mates with the mating connector 3, the contact members 61*a*, 62*a* of the first and second mating contacts 61, 62 are protected by the shutter member 70 so that the adhesion of foreign matter such as dirt or dust thereto is prevented. A plurality of stopper projections 71 that protrude to the outside are provided at both front and back edges of the shutter member 70. A plurality of restricting members 81 that restrict the upward movement of the shutter member 70, as a result of the contact with the stopper projections 71, are provided on each of the shell members 80 that are attached to the mating housing 50. Accordingly, the upward movement of the shutter member 70 is restricted with a simple construction.

When the electrical connector 2 mates with the mating connector 3 in a direction of the arrows shown in FIG. 1, the first and second contacts 21, 22 of the electrical connector 2 are aligned with the first and second mating contacts 61, 62 of the mating connector 3, as a result of the positioning guides 13 being guided during insertion into the positioning recessed members 53. The mating member 12 of the electrical connector 2 mates with the mating recessed member 51 while pressing the shutter member 70 downward. As a result, the contact members 21*a* of the first contacts 21 of the electrical connector 2 contact the contact members 61*a* of the first mating contacts 61 to electrically connect the signal lines (not shown) provided on the circuit board (not shown) on the side of the expansion unit (not shown) to the signal lines (not shown) provided on the circuit board (not shown) on the side of the personal computer (not shown). Additionally, the contact members 22*a* of the second contacts 22 contact the contact members 62*a* of the second mating contacts 62, so that the power supply lines (not shown) provided on the circuit board (not shown) on the side of the expansion unit (not shown) are electrically connected to the power supply lines (not shown) provided on the circuit board (not shown) on the side of the personal computer (not shown). The shells 40 of the electrical connector 2 and the shell members 80 of the mating connector 3 come into contact with each other, so that grounding is accomplished. Further, the barrier walls 15 of the electrical connector 2 are received in the barrier wall recessed members 54.

The foregoing illustrates some of the possibilities for practicing the invention. Many other embodiments are possible within the scope and spirit of the invention. For example, the location of the barrier walls 15 may be altered depending on the desired arrangement of the first and second contacts 21, 22. Furthermore, as long as the barrier walls 15 partition the first and second contacts 21, 22, it is not necessary that the barrier walls 15 extend upward from the bottom surfaces of the mating recessed members 12*b* to the mating surface (upper surface) of the mating member 12. Moreover, it is possible to mount the electrical connector 2 on the circuit board (not shown) provided on the side of the personal computer (not shown) and to mount the mating connector 3 on the circuit board (not shown) provided on the side of the expansion unit (not shown). In addition, the positioning guides 13 and positioning recessed members 53 could be provided in other locations. It is, therefore, intended that the foregoing description be regarded as illustrative rather than limiting, and that the scope of the invention is given by the appended claims together with their full range of equivalents.

What is claimed is:

1. An electrical connector assembly, comprising:

an electrical connector having an insulating housing provided with first and second contacts, a positioning guide protruding from a mating surface of the housing, and at least one barrier wall formed between the first and second contacts that separates the first contacts from the second contacts;

a mating connector having an insulating mating housing, provided with first and second mating contacts, a positioning recessed member that receives the positioning guide, and at least one barrier wall recessed member formed between the first and second mating contacts that separates the first mating contacts from the second mating contacts, the barrier wall recessed member receives the barrier wall when the electrical connector is mated with the mating connector; and a shutter member provided on the mating connector, the shutter member being moveable between an upper position and a lower position, the shutter member covering the first and second mating contacts in the upper position.

2. The electrical connector assembly of claim 1, wherein the mating surface includes a pair of mating recessed members extending substantially parallel to each other along a direction of length of the housing, each of the mating recessed members being provided with first and second contacts.

3. The electrical connector assembly of claim 2, wherein the first contacts are signal contacts and the second contacts are power supply contacts.

4. The electrical connector assembly of claim 2, wherein the each of the first and second contacts has a contact member and board connecting member, the contact member extending upward along the mating recessed members and the board connecting members protruding downward from a bottom of the housing.

5. The electrical connector assembly of claim 2, wherein the barrier wall is provided in at least one of the mating recessed members.

6. The electrical connector assembly of claim 5, wherein the barrier wall extends from a bottom surface of the mating recessed member to the mating surface.

7. The electrical connector assembly of claim 1, wherein the barrier wall is narrower at a top thereof.

8. The electrical connector assembly of claim 1, wherein the positioning guide is provided with a metal plate.

9. The electrical connector assembly of claim 1, wherein the shutter member is constantly driven toward the upper position by elastic members.

10. The electrical connector assembly of claim 9, wherein the mating housing includes metal shell members.

11. The electrical connector assembly of claim 10, further comprising restricting members that restrict the upward movement of the shutter member are provided on the shell members.

* * * * *